US011167294B2

(12) United States Patent
Yan et al.

(10) Patent No.: US 11,167,294 B2
(45) Date of Patent: Nov. 9, 2021

(54) MULTIFUNCTIONAL PULL-OUT SPRAY HEAD

(71) Applicant: Xiamen Forbetter Sanitary Ware Co., Ltd., Fujian (CN)

(72) Inventors: Xiliang Yan, Xiamen (CN); Yihui Chen, Xiamen (CN); Xingui Zhang, Xiamen (CN); Wenbo Wu, Xiamen (CN)

(73) Assignee: XIAMEN FORBETTER SANITARY WARE CO., LTD., Fujian (CN)

( * ) Notice: Subject to any disclaimer, the term of this patent is extended or adjusted under 35 U.S.C. 154(b) by 246 days.

(21) Appl. No.: 16/425,948

(22) Filed: May 30, 2019

(65) Prior Publication Data

US 2020/0376504 A1 Dec. 3, 2020

(51) Int. Cl.
*B05B 1/16* (2006.01)
*E03C 1/04* (2006.01)

(52) U.S. Cl.
CPC ..... *B05B 1/169* (2013.01); *B05B 1/1681* (2013.01); *E03C 1/0404* (2013.01); *E03C 2001/0415* (2013.01)

(58) Field of Classification Search
CPC ..... B05B 1/169; B05B 1/1681; B05B 1/1618; E03C 1/0405; E03C 1/0404; E03C 2001/0415
See application file for complete search history.

(56) References Cited

U.S. PATENT DOCUMENTS 7,070,125 B2 * 7/2006 Williams ..... B05B 1/1618 239/443
8,152,078 B2 * 4/2012 Jianglin ..... B05B 1/3013 239/528
8,800,893 B2 * 8/2014 Malek ..... B05B 1/1618 239/447

* cited by examiner

*Primary Examiner* — Steven M Cernoch
(74) *Attorney, Agent, or Firm* — Leong C. Lei

(57) ABSTRACT

A multifunctional pull-out spray head includes a switching assembly, a water inlet assembly, and a water outlet assembly. The switching assembly controls three waterways of a switching assembly main body through a first button, a first switching unit and a second switching unit. The water inlet assembly realizes on-off control of the switching assembly. The spray head realizes the switching of three spray modes and meets the user's demand for multiple functions. The overall structure is compact, the size is small, and the operation is convenient.

18 Claims, 11 Drawing Sheets

MULTIFUNCTIONAL PULL-OUT SPRAY HEAD

BACKGROUND OF THE INVENTION

1. Field of the Invention

The present invention relates to sanitary wares, and more particularly, to a multifunctional pull-out spray head.

2. Description of the Prior Art

Pull-out spray heads are new popular sanitary wares in recent years. They are generally installed on wash basins for the user to wash his/her hair or face or cleaning the bathroom. The spray head has different spray modes for different purposes so as to achieve a better cleaning effect. The existing pull-out spray heads have few functions. In general, the spray head is provided with a switching button for switching two different spray modes, which is difficult to meet the increasing demands of users. For increasing the functions of the pull-out spray head, it is necessary to increase the number of buttons and waterways. The pull-out spray head becomes larger and heavier, which not only increases the production cost but also is inconvenient for use.

SUMMARY OF THE INVENTION

The primary object of the present invention is to provide a multifunctional pull-out spray head with three spray modes and a pause function, which meets the user's demand for multiple functions and is compact in structure, small in size, and convenient for the user to operate.

In order to achieve the above object, the present invention adopts the following technical solutions:

A multifunctional pull-out spray head comprises a switching assembly, a water inlet assembly and a water outlet assembly that are mounted in a housing. The water inlet assembly and the water outlet assembly are fitted to a water inlet end and a water outlet end of the switching assembly, respectively. The switching assembly includes a switching assembly main body, a first switching unit, a second switching unit, and a first button. A surface of the switching assembly main body is recessed to form a first water-passing chamber and a second water-passing chamber. The first water-passing chamber and the second water-passing chamber have openings arranged in a same direction. The first switching unit is fitted in the first water-passing chamber. The second switching unit is fitted in the second water-passing chamber. A water inlet end of the switching assembly main body is formed with a first water inlet passage. A water outlet end of the switching assembly main body is formed with a first water outlet passage, a second water outlet passage and a third water outlet passage that are not in communication with each other. The first water-passing chamber is formed with a first water inlet, a first water outlet, and a second water outlet. The first water outlet, the first water inlet and the second water outlet are sequentially disposed on an inner wall of the first water-passing chamber along an axial direction of the first water-passing chamber. The first water outlet is located at a bottom of the first water-passing chamber. The first water inlet communicates with the first water inlet passage. The second water outlet communicates with the first water outlet passage. The second water-passing chamber is formed with a second water inlet, a third water outlet, and a fourth water outlet. The third water outlet, the second water inlet and the fourth water outlet are sequentially disposed on an inner wall of the second water-passing chamber along an axial direction of the second water-passing chamber. The third water outlet is located at a bottom of the second water-passing chamber. The second water inlet communicates with the first water outlet. The third water outlet communicates with the second water outlet passage. The fourth water outlet communicates with the third water outlet passage. A middle portion of the first button is hingedly connected to the surface of the switching assembly main body and is located between the opening of the first water-passing chamber and the opening of the second water-passing chamber.

The first switching unit includes a first switching valve, a first switching rod, and a first return spring. The first switching valve is sealedly fitted between the opening of the first water-passing chamber and the first water inlet and blocks the second water outlet. The first switching valve is formed with a first chamber having an opening facing the first water outlet. The opening of the first chamber corresponds in shape and in size to the first water outlet. A side wall of the first chamber is provided with a first slot communicating with the second water outlet. A bottom of the first chamber is provided with a first hole that is disposed along the axial direction of the first water-passing chamber. The first switching rod is movably fitted in the first hole. One end of the first switching rod is movably connected to one end of the first button. Another end of the first switching rod is formed with a first sealing portion. The first return spring is disposed between the first sealing portion and the bottom of the first water-passing chamber. The first return spring presses the first sealing portion to be movably fitted to the opening of the first chamber.

The second switching unit includes a second switching valve, a second switching rod, and a second return spring. The second switching valve is sealedly fitted between the opening of the second water-passing chamber and the second water inlet and blocks the fourth water outlet. The second switching valve is formed with a second chamber having an opening facing the third water outlet. The opening of the second chamber corresponds in shape and in size to the third water outlet. A side wall of the second chamber is provided with a second slot communicating with the fourth water outlet. A bottom of the second chamber is provided with a second hole that is disposed along the axial direction of the second water-passing chamber. The second switching rod is movably fitted in the second hole. One end of the second switching rod is movably connected to another end of the first button. Another end of the second switching rod is formed with a second sealing portion. The second return spring is disposed between the second sealing portion and the bottom of the second water-passing chamber. The second return spring presses the second sealing portion to be movably fitted to the opening of the second chamber.

Preferably, the water inlet assembly includes a water inlet assembly main body, a third switching unit, and a second button. A surface of the water inlet assembly main body is recessed to form a fifth water-passing chamber. The fifth water-passing chamber has an opening in the same direction as the opening of the first water-passing chamber. The third switching unit is fitted in the fifth water-passing chamber. A water inlet end of the water inlet assembly main body is formed with a second water inlet passage. A water outlet end of the water inlet assembly main body is formed with a fourth water outlet passage. The fourth water outlet passage is in communication with the first water inlet passage. The fifth water-passing chamber is formed with a third water inlet and a fifth water outlet. The third water inlet is disposed on a side wall of the fifth water-passing chamber. The fifth water outlet is located at a bottom of the fifth water-passing chamber. The third water inlet communicates with the second water inlet passage. The fifth water outlet communicates with the fourth water outlet passage. The third switching unit includes a third switching valve, a third switching rod, and a third return spring. The third switching valve is sealedly fitted between the opening of the fifth water-passing chamber and the third water inlet. The third switching valve is formed with a third chamber having an opening facing the fifth water outlet. The opening of the third chamber corresponds in shape and in size to the fifth water outlet. A bottom of the third chamber is provided with a third hole that is disposed along an axial direction of the fifth water-passing chamber. The third switching rod is movably fitted in the third hole. One end of the third switching rod is formed with a third sealing portion. The third return spring is disposed between the third sealing portion and the bottom of the fifth water-passing chamber. The third return spring presses the third sealing portion to be movably fitted to the opening of the third chamber.

Preferably, another end of the third switching rod is connected to the second button.

Preferably, the housing is formed with a first through hole corresponding in position to the first button, and the first button is movably disposed in the first through hole. The housing is formed with a second through hole corresponding in position to the second button, and the second button is movably disposed in the second through hole.

Preferably, a side portion of the switching assembly main body is formed with a third water-passing chamber and a fourth water-passing chamber. The first water outlet passage and the second water outlet are in communication with the third water-passing chamber. The first water outlet and the second water inlet are in communication with the fourth water-passing chamber. The third water-passing chamber and the fourth water-passing chamber are located at two sides of the first water-passing chamber/the second water-passing chamber, respectively.

Preferably, one end of the first switching rod is hingedly connected to one end of the first button.

Preferably, the bottom of the first water-passing chamber is provided with a first limiting post. The first limiting post is disposed along the axial direction of the first water-passing chamber. The first sealing portion is formed with a first sleeve hole. The first sleeve hole is moveably sleeved onto an outer circumference of the first limiting post.

Preferably, an outer circumference of the first switching valve is provided with a first sealing ring and a second sealing ring that are disposed along a circumferential direction of the first switching valve. The first sealing ring and the second sealing ring are located at upper and lower ends of the first slot.

Preferably, a middle portion of the first switching rod is provided with a first lip-shaped sealing ring, and the first lip-shaped sealing ring is moveably fitted in the first hole.

Preferably, an outer circumference of the first sealing portion is sleeved with a third sealing ring that is disposed along a circumferential direction of the first sealing portion, and the third sealing ring is moveably fitted to the opening of the first chamber or the first water outlet.

Preferably, the bottom of the second water-passing chamber is provided with a second limiting post. The second limiting post is disposed along the axial direction of the second water-passing chamber. The second sealing portion is formed with a second sleeve hole. The second sleeve hole is moveably sleeved onto an outer circumference of the second limiting post.

Preferably, an outer circumference of the second switching valve is provided with a fourth sealing ring and a fifth sealing ring that are disposed along a circumferential direction of the second switching valve. The fourth sealing ring and the fifth sealing ring are located at upper and lower ends of the second slot.

Preferably, a middle portion of the second switching rod is provided with a second lip-shaped sealing ring, and the second lip-shaped sealing ring is movably fitted in the second hole.

Preferably, an outer circumference of the second sealing portion is sleeved with a third lip-shaped sealing ring that is disposed along a circumferential direction of the second sealing portion, and the third lip-shaped sealing ring is movably fitted to the opening of the second chamber or the third water outlet.

Preferably, the first switching valve is rotatably fitted to the opening of the first water-passing chamber.

Preferably, the second switching valve is rotatably fitted to the opening of the second water-passing chamber.

Preferably, the bottom of the fifth water-passing chamber is provided with a third limiting post. The third limiting post is disposed along the axial direction of the fifth water-passing chamber. The third sealing portion is formed with a third sleeve hole. The third sleeve hole is moveably sleeved onto an outer circumference of the third limiting post.

Preferably, the third switching valve is rotatably fitted to the opening of the fifth water-passing chamber.

Preferably, the water outlet assembly includes a water outlet assembly main body, a bubbler, a nozzle, and a gasket. The water outlet assembly main body is provided with a plurality of first perforations and a plurality of second perforations. A central portion of the water outlet assembly main body is formed with a mounting trough. The bubbler is locked in the mounting trough through the nozzle. The gasket is disposed between the bubbler and the water outlet assembly main body. The first water outlet passage is in communication with the first perforations. The second water outlet passage is in communication with a bottom of the mounting trough. The third water outlet passage is in communication with the second perforations.

Through the above structure, the present invention includes the first switching unit to control the water flow from the two water outlets of the first water-passing chamber, the second switching unit to control the water flow from the two water outlets of the second water-passing chamber, and the first button to control the first switching unit and the second switching unit, so as to implement three different spray modes of the present invention, which can meet the user's demand for multiple functions. The present invention has the advantages of compact structure, small size, convenient operation for the user, and reduced production cost.

In addition, the present invention can achieve a flow adjustment or on-off control by controlling the water-passing area of the water inlet assembly. The components constituting the first switching unit, the second switching unit and the third switching unit have the same or similar structure and can be replaced with each other. This means that the components of the three switching units can be produced with the same mold to reduce the production cost, and it is convenient for assembly.

DETAILED DESCRIPTION OF THE PREFERRED EMBODIMENTS

Figure 1:
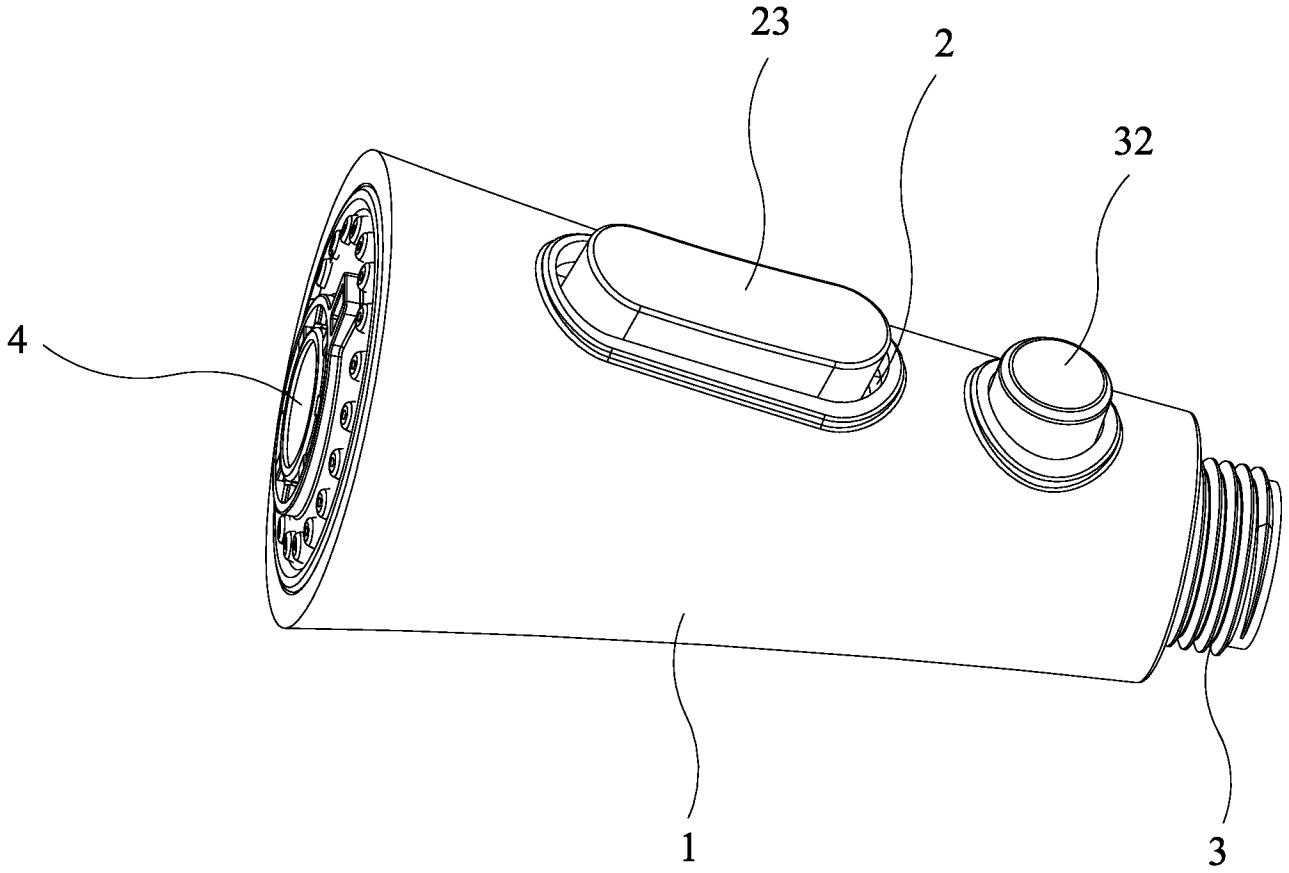
FIG. 1 is a perspective view in accordance with a preferred embodiment of the present invention.

In order to further explain the technical solution of the present invention, embodiments of the present invention will now be described, by way of example only, with reference to the accompanying drawings.

As shown in FIG. 1 through FIG. 9, the present invention provides a multifunctional pull-out spray head, comprising a switching assembly 2, a water inlet assembly 3 and a water outlet assembly 4 that are mounted in a housing 1. The water inlet assembly 3 and the water outlet assembly 4 are fitted to a water inlet end and a water outlet end of the switching assembly 2, respectively. The water inlet assembly 3 is configured to adjust the flow rate and on-off control of water flowing into the switching assembly 2. The switching assembly 2 is configured to control and switch three different waterways therein. The water outlet assembly 4 is configured to achieve different spray modes corresponding to the waterways of the switching assembly 2.

The switching assembly 2 includes a switching assembly main body 20, a first switching unit 21, a second switching unit 22, and a first button 23.

Referring to FIG. 4, FIG. 5, FIG. 6, FIG. 8, and FIG. 10, the surface of the switching assembly main body 20 is recessed to form a first water-passing chamber 201 and a second water-passing chamber 202. The first water-passing chamber 201 and the second water-passing chamber 202 have openings arranged in the same direction. The first switching unit 21 is fitted in the first water-passing chamber 201, and the second switching unit 22 is fitted in the second water-passing chamber 202. A water inlet end of the switching assembly main body 20 is formed with a first water inlet passage 203. A water outlet end of the switching assembly main body 20 is formed with a first water outlet passage 204, a second water outlet passage 205, and a third water outlet passage 206 that are not in communication with each other. The first water-passing chamber 201 is formed with a first water inlet 2011, a first water outlet 2012, and a second water outlet 2013. The first water outlet 2012, the first water inlet 2011 and the second water outlet 2013 are sequentially disposed on the inner wall of the first water-passing chamber 201 along the axial direction of the first water-passing chamber 201. The first water outlet 2012 is located at the bottom of the first water-passing chamber 201. The first water inlet 2011 communicates with the first water inlet passage 203. The second water outlet 2013 communicates with the first water outlet passage 204. The second water-passing chamber 202 is formed with a second water inlet 2021, a third water outlet 2022, and a fourth water outlet 2023. The third water outlet 2022, the second water inlet 2021 and the fourth water outlet 2023 are sequentially disposed on the inner wall of the second water-passing chamber 202 along the axial direction of the second water-passing chamber 202. The third water outlet 2022 is located at the bottom of the second water-passing chamber 202. The second water inlet 2021 communicates with the first water outlet 2012. The third water outlet 2022 communicates with the second water outlet passage 205. The fourth water outlet 2023 communicates with the third water outlet passage 206.

In this embodiment, a side portion of the switching assembly main body 20 is formed with a third water-passing chamber 207 and a fourth water-passing chamber 208. The first water outlet passage 204 and the second water outlet 2013 are in communication with the third water-passing chamber 207, respectively. The first water outlet 2012 and the second water inlet 2021 are in communication with the fourth water-passing chamber 208, respectively. The third water-passing chamber 207 and the fourth water-passing chamber 208 are located at two sides of the first water-passing chamber 201/the second water-passing chamber 202, respectively. By forming the third water-passing chamber 207 and the fourth water-passing chamber 208 on the side portion of the switching assembly main body 20, it is convenient to form waterways inside the switching assembly main body 20 during production. The mold is first removed to form the third water-passing chamber 207/the fourth water-passing chamber 208, and then the cover plate is welded for sealing.

A middle portion of the first button 23 is hingedly connected to the surface of the switching assembly main body 20 and located between the opening of the first water-passing chamber 201 and the opening of the second water-passing chamber 202.

Figure 2:
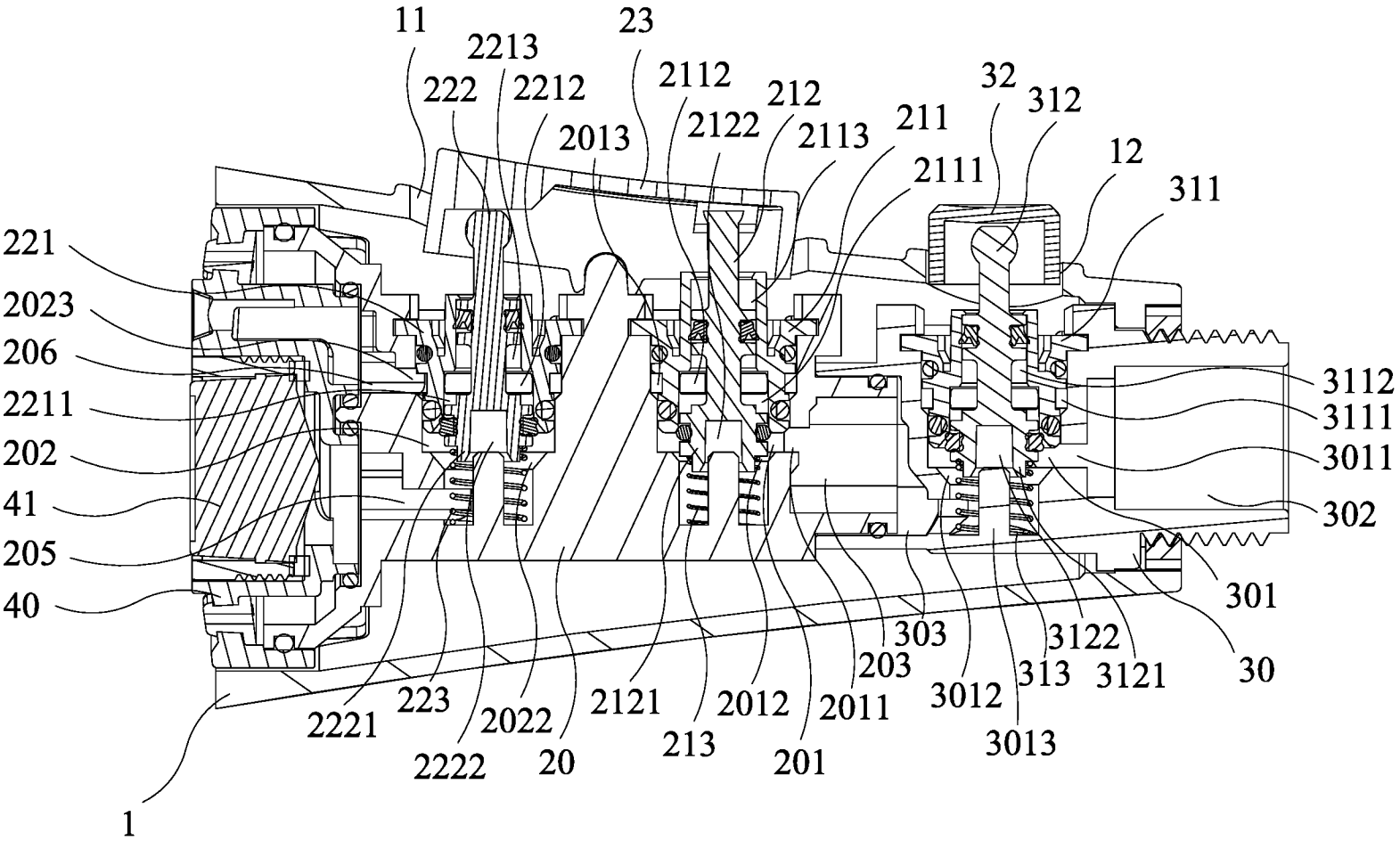
FIG. 2 is a cross-sectional view in accordance with the preferred embodiment of the present invention.
Figure 3:
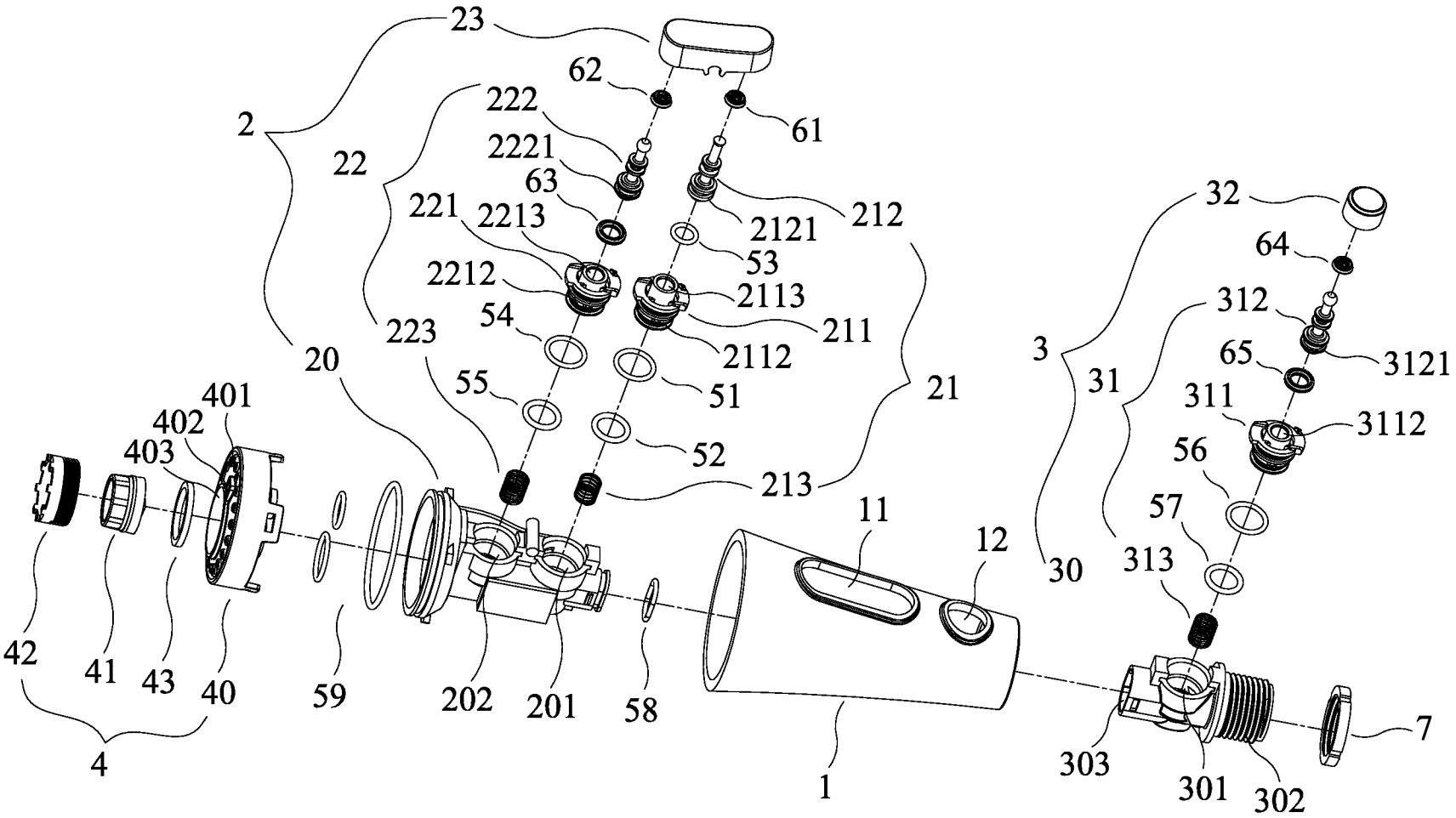
FIG. 3 is an exploded view in accordance with the preferred embodiment of the present invention.

Referring to FIG. 2 and FIG. 3, the first switching unit 21 includes a first switching valve 211, a first switching rod 212, and a first return spring 213. The first switching valve 211 is sealedly fitted between the opening of the first water-passing chamber 201 and the first water inlet 2011 and blocks the second water outlet 2013. The first switching valve 211 is formed with a first chamber 2111 having an opening facing the first water outlet 2012. The opening of the first chamber 2111 corresponds in shape and in size to the first water outlet 2012. The side wall of the first chamber 2111 is provided with a first slot 2112 communicating with the second water outlet 2013. The bottom of the first chamber 2111 is provided with a first hole 2113 that is disposed along the axial direction of the first water-passing chamber 201. The first switching rod 212 is movably fitted in the first hole 2113. One end of the first switching rod 212 is movably connected to one end of the first button 23, and another end of the first switching rod 212 is formed with a first sealing portion 2121. The first return spring 213 is disposed between the first sealing portion 2121 and the bottom of the first water-passing chamber 201. The first return spring 213 presses the first sealing portion 2121 to be movably fitted to the opening of the first chamber 2111.

In this embodiment, the first switching valve 211 is rotatably fitted to the opening of the first water-passing chamber 201, so as to facilitate the disassembly and assembly of the first switching valve 211. The bottom of the first water-passing chamber 201 is provided with a first limiting post 2014. The first limiting post 2014 is disposed along the axial direction of the first water-passing chamber 201. The first sealing portion 2121 is formed with a first sleeve hole 2122. The first sleeve hole 2122 is moveably sleeved onto the outer circumference of the first limiting post 2014, thereby ensuring the moving direction of the first sealing portion 2121. The outer circumference of the first switching valve 211 is provided with a first sealing ring 51 and a second sealing ring 52 that are disposed along the circumferential direction of the first switching valve 211. The first sealing ring 51 and the second sealing ring 52 are located at upper and lower ends of the first slot 2112, thereby enhancing the airtightness between the first switching valve 211 and the first water-passing chamber 201. A middle portion of the first switching rod 212 is provided with a first lip-shaped sealing ring 61. The first lip-shaped sealing ring 61 is moveably fitted in the first hole 2113 to further improve the airtightness between the first switching rod 212 and the first hole 2113 so as to prevent water leakage. The outer circumference of the first sealing portion 2121 is sleeved with a third sealing ring 53 that is disposed along the circumferential direction of the first sealing portion 2121. The third sealing ring 53 is movably fitted to the opening of the first chamber 2111 or the first water outlet 2012, thereby enhancing the working stability of the first sealing portion 2121. One end of the first switching rod 212 is hingedly connected to one end of the first button 23. The rotation of the first button 23 on the switching assembly main body 20 can drive the first switching rod 212 to move. When a force is applied to the other end of the first button 23, the first sealing portion 2112 is returned faster.

Referring to FIG. 2 and FIG. 3, the second switching unit 22 includes a second switching valve 221, a second switching rod 222, and a second return spring 223. The second switching valve 221 is sealedly fitted between the opening of the second water-passing chamber 202 and the second water inlet 2021 and blocks the fourth water outlet 2023. The second switching valve 221 is formed with a second chamber 2211 having an opening facing the third water outlet 2022. The opening of the second chamber 2211 corresponds in shape and in size to the third water outlet 2022. The side wall of the second chamber 2211 is provided with a second slot 2212 communicating with the fourth water outlet 2023. The bottom of the second chamber 2211 is provided with a second hole 2213 that is disposed along the axial direction of the second water-passing chamber 202. The second switching rod 222 is movably fitted in the second hole 2213. One end of the second switching rod 222 is movably connected to the other end of the first button 23, and another end of the second switching rod 222 is formed with a second sealing portion 2221. The second return spring 223 is disposed between the second sealing portion 2221 and the bottom of the second water-passing chamber 202. The second return spring 223 presses the second sealing portion 2221 to be movably fitted to the opening of the second chamber 2211.

In this embodiment, the second switching valve 221 is rotatably fitted to the opening of the second water-passing chamber 202, so as to facilitate the disassembly and assembly of the second switching valve 221. The bottom of the second water-passing chamber 202 is provided with a second limiting post 2024. The second limiting post 2024 is disposed along the axial direction of the second water-passing chamber 202. The second sealing portion 2221 is formed with a second sleeve hole 2222. The second sleeve hole 2222 is moveably sleeved onto the outer circumference of the second limiting post 2024, thereby ensuring the moving direction of the second sealing portion 2221. The outer circumference of the second switching valve 221 is provided with a fourth sealing ring 54 and a fifth sealing ring 55 that are disposed along the circumferential direction of the second switching valve 221. The fourth sealing ring 54 and the fifth sealing ring 55 are located at upper and lower ends of the second slot 2212, thereby enhancing the airtightness between the second switching valve 221 and the second water-passing chamber 202. A middle portion of the second switching rod 222 is provided with a second lip-shaped sealing ring 62. The second lip-shaped sealing ring 62 is movably fitted in the second hole 2213 to further improve the airtightness between the second switching rod 222 and the second hole 2213 so as to prevent water leakage. The outer circumference of the second sealing portion 2221 is sleeved with a third lip-shaped sealing ring 63 that is disposed along the circumferential direction of the second sealing portion 2221. The third lip-shaped sealing ring 63 is movably fitted to the opening of the second chamber 2211 or the third water outlet 2022, thereby enhancing the working stability of the second sealing portion 2221.

Referring to FIG. 2 and FIG. 3, the water inlet assembly 3 includes a water inlet assembly main body 30, a third switching unit 31, and a second button 32. The surface of the water inlet assembly main body 30 is recessed to form a fifth water-passing chamber 301. The fifth water-passing chamber 301 has an opening in the same direction as the opening of the first water-passing chamber 201. The third switching unit 31 is fitted in the fifth water-passing chamber 301. A water inlet end of the water inlet assembly main body 30 is formed with a second water inlet passage 302. A water outlet end of the water inlet assembly main body 30 is formed with a fourth water outlet passage 303. The fourth water outlet passage 303 is in communication with the first water inlet passage 203. The fifth water-passing chamber 301 is formed with a third water inlet 3011 and a fifth water outlet 3012. The third water inlet 3011 is disposed on the side wall of the fifth water-passing chamber 301. The fifth water outlet 3012 is located at the bottom of the fifth water-passing chamber 301. The third water inlet 3011 communicates with the second water inlet passage 302. The fifth water outlet 3012 communicates with the fourth water outlet passage 303.

The third switching unit 31 includes a third switching valve 311, a third switching rod 312, and a third return spring 313. The third switching valve 311 is sealedly fitted between the opening of the fifth water-passing chamber 301 and the third water inlet 3011. The third switching valve 311 is formed with a third chamber 3111 having an opening facing the fifth water outlet 3012. The opening of the third chamber 3111 corresponds in shape and in size to the fifth water outlet 3012. The bottom of the third chamber 3111 is provided with a third hole 3112 that is disposed along the axial direction of the fifth water-passing chamber 301. The third switching rod 312 is movably fitted in the third hole 3112. One end of the third switching rod 312 is formed with a third sealing portion 3121. Another end of the third switching rod 312 is connected to the second button 32. The third return spring 313 is disposed between the third sealing portion 3121 and the bottom of the fifth water-passing chamber 301. The third return spring 313 presses the third sealing portion 3121 to be movably fitted to the opening of the third chamber 3111.

In this embodiment, the third switching valve 311 is rotatably fitted to the opening of the fifth water-passing chamber 301, so as to facilitate the disassembly and assembly of the third switching valve 311. The bottom of the fifth water-passing chamber 301 is provided with a third limiting post 3013. The third limiting post 3013 is disposed along the axial direction of the fifth water-passing chamber 301. The third sealing portion 3121 is formed with a third sleeve hole 3122. The third sleeve hole 3122 is moveably sleeved onto the outer circumference of the third limiting post 3013, thereby ensuring the moving direction of the third sealing portion 3121. The outer circumference of the third switching valve 311 is provided with a sixth sealing ring 56 and a seventh sealing ring 57 that are disposed along the circumferential direction of the third switching valve 311. The sixth sealing ring 56 and the seventh sealing ring 57 are sealedly fitted between the outer circumference of the third switching valve 311 and the side wall of the fifth water-passing chamber 301, thereby enhancing the airtightness between the third switching valve 311 and the fifth water-passing chamber 301. A middle portion of the third switching rod 312 is provided with a fourth lip-shaped sealing ring 64. The fourth lip-shaped sealing ring 64 is movably fitted in the third hole 3113 to further improve the airtightness between the third switching rod 312 and the third hole 3112 so as to prevent water leakage. The outer circumference of the third sealing portion 3121 is sleeved with a fifth lip-shaped sealing ring 65 that is disposed along the circumferential direction of the third sealing portion 3121. The fifth lip-shaped sealing ring 65 is sealedly fitted to the opening of the third chamber 3111 or the fifth water outlet 3012, thereby enhancing the working stability of the third sealing portion 3121. The first water inlet passage 203 is sealedly fitted in the fourth water outlet passage 303. An eighth sealing ring 58 is disposed between the outer circumference of the first water inlet passage 203 and the inner wall of the fourth water outlet passage 303. The water inlet assembly 3 is locked to the end of the housing 1 by a nut 7.

Referring to FIG. 2 and FIG. 3, the water outlet assembly 4 includes a water outlet assembly main body 40, a bubbler 41, a nozzle 42, and a gasket 43. The water outlet assembly main body 40 is provided with a plurality of first perforations 401 and a plurality of second perforations 402. A central portion of the water outlet assembly main body 40 is formed with a mounting trough 403. The bubbler 41 is locked in the mounting trough 403 through the nozzle 42. The gasket 43 is disposed between the bubbler 41 and the water outlet assembly main body 40. The first water outlet passage 204 is in communication with the first perforations 401. The second water outlet passage 205 is in communication with the bottom of the mounting trough 403. The third water outlet passage 206 is in communication with the second perforations 402.

In this embodiment, the housing 1 is formed with a first through hole 11 corresponding in position to the first button 23. The first button 23 is movably disposed in the first through hole 11. The housing 1 is formed with a second through hole 12 corresponding in position to the second button 32. The second button 32 is movably disposed in the second through hole 12. A ninth sealing ring 59 is disposed between the water outlet ends of the water outlet assembly 4 and the switching assembly 2 to improve the airtightness.

Referring to FIG. 4, FIG. 5, FIG. 6, and FIG. 7, a first spray mode of the present invention is shown, namely, in an initial state. The first return spring 213 presses the first sealing portion 2121 to be sealedly fitted to the opening of the first chamber 2111, and the first water outlet 2012 is opened. The second return spring 223 presses the second sealing portion 2221 to be sealedly fitted to the opening of the second chamber 2211, and the third water outlet 2022 is opened. The third return spring 313 presses the third sealing portion 3121 to be sealedly fitted to the opening of the third chamber 3111, and the fifth water outlet 3012 is opened. At this time, the water flow sequentially passes through the second water inlet passage 302 and the third water inlet 3011 to enter the fifth water-passing chamber 301, and passes through the fifth water outlet 3012 to enter the fourth water outlet passage 303 and the first water inlet passage 203, and passes through the first water inlet 2011 to enter the first water-passing chamber 201, and passes through the first water outlet 2012 to enter the fourth water-passing chamber 208, and passes through the second water inlet 2021 to enter the second water-passing chamber 202, and passes through the third water outlet 2022 to enter the second water outlet passage 205, and is finally discharged from the bubbler 41. The opening of the first chamber 2111 is blocked by the first sealing portion 2121, so the water flow cannot enter the first water outlet passage 204. The opening of the second chamber 2211 is blocked by the second sealing portion 2221, so the water flow cannot enter the third water outlet passage 206.

Referring to FIG. 4, FIG. 5, FIG. 8 and FIG. 9, a second spray mode of the present invention is shown. In the initial state, the other end (the end that is movably fitted to the second switching rod 222) of the first button 23 is switched to the second spray mode. The other end of the first button 23 presses the second switching rod 222 to move toward the bottom of the second water-passing chamber 202. The second sealing portion 2221 is disengaged from the opening of the second chamber 2211 to be sealedly fitted to the third water outlet 2022. The other configurations remain the same as in the initial state. At this time, the water flow sequentially passes through the second water inlet passage 302 and the third water inlet 3011 to enter the fifth water-passing chamber 301, and passes through the fifth water outlet 3012 to enter the fourth water outlet passage 303 and the first water inlet passage 203, and passes through the first water inlet 2011 to enter the first water-passing chamber 201, and passes through the first water outlet 2012 to enter the fourth water-passing chamber 208, and passes through the second water inlet 2021 to enter the second water-passing chamber 202, and passes through the opening of the second chamber 2211, the second slot 2212 and the fourth water outlet 2023 to enter the third water outlet passage 206, and is finally discharged from the second perforations 402 of the water outlet assembly body 40. The opening of the first chamber 2111 is blocked by the first sealing portion 2121, so the water flow cannot enter the first water outlet passage 204. The third water outlet 2022 is blocked by the second sealing portion 2221, so the water flow cannot enter the second water outlet passage 205. The second spray mode depends on the elastic force of the second return spring 223. If the elastic force of the second return spring 223 is greater than the water pressure, it is necessary to continuously press the other end of the first button 23 to maintain the second spray mode. If the elastic force of the second return spring 223 is less than the water pressure, after switching to the second spray mode, the second spray mode can be maintained without continuous application of force. The initial state will be automatically restored after the water flow is stopped.

Referring to FIG. 4, FIG. 5, FIG. 10 and FIG. 11, a third spray mode of the present invention is shown. In the initial state, one end (the end that is movably fitted to the first switching rod 212) of the first button 23 is switched to the third spray mode. One end of the first button 23 presses the first switching rod 212 to move toward the bottom of the first water-passing chamber 201. The first sealing portion 2121 is disengaged from the opening of the first chamber 2111 to be sealedly fitted to the first water outlet 2012. The other configurations remain the same as in the initial state. At this time, the water flow sequentially passes through the second water inlet passage 302 and the third water inlet 3011 to enter the fifth water-passing chamber 301, and passes through the fifth water outlet 3012 to enter the fourth water outlet passage 303 and the first water inlet passage 203, and passes through the first water inlet 2011 to enter the first water-passing chamber 201, and passes through the opening of the first chamber 2111, the first slot 2112 and the second water outlet 2013 to enter the third water-passing chamber 207 and the first water outlet passage 204, and is finally discharged from the first perforations 401 of the water outlet assembly body 40. The first water outlet 2012 is blocked by the first sealing portion 2121, so the water flow cannot enter the second water-passing chamber 202, the second water outlet passage 205, and the third water outlet passage 206. The third spray mode depends on the elastic force of the first return spring 213. If the elastic force of the first return spring 213 is greater than the water pressure, it is necessary to continuously press the other end of the first button 23 to maintain the third spray mode. If the elastic force of the first return spring 213 is less than the water pressure, after switching to the third spray mode, the third spray mode can be maintained without continuous application of force. However, in the corresponding structure, one end of the first switching rod 212 must be hingedly connected to one end of the first button 23 to ensure that the third spray mode can be switched to the second spray mode. The initial state will be automatically restored after the water flow is stopped.

Figure 4:
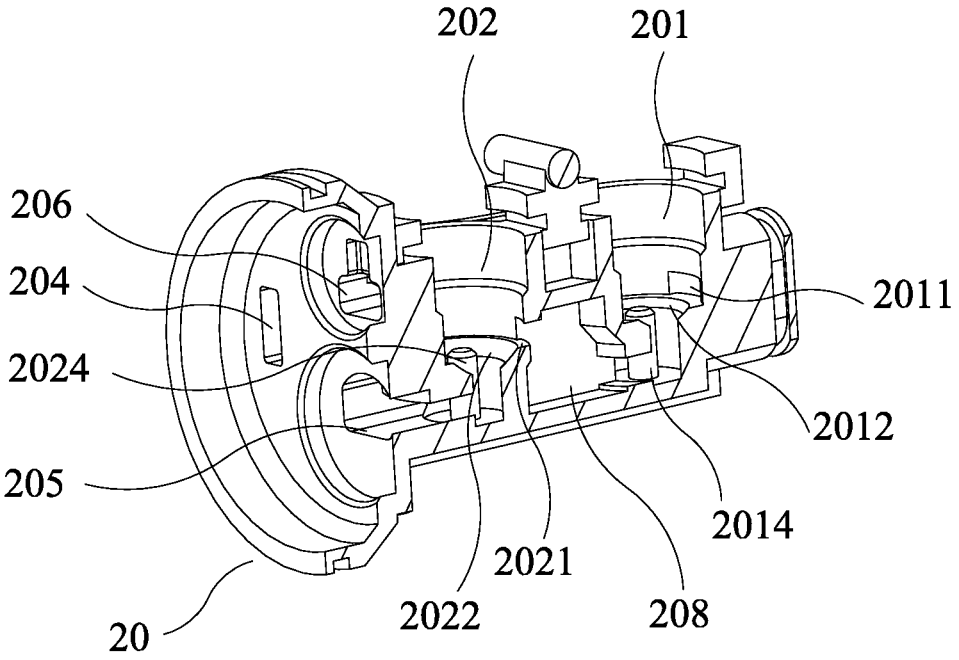
FIG. 4 is a cross-sectional view of the switching assembly main body in accordance with the preferred embodiment of the present invention.
Figure 5:
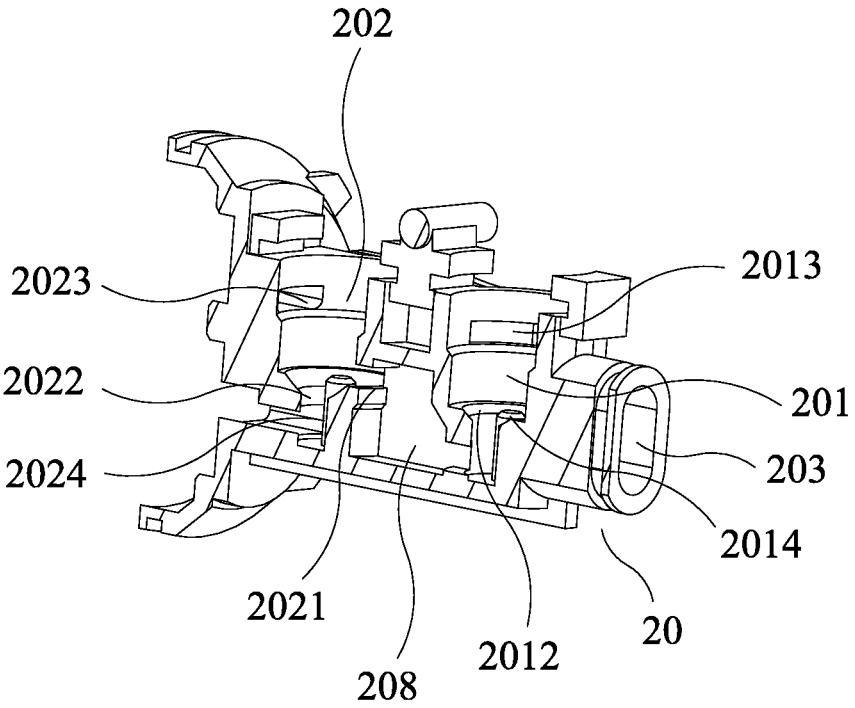
FIG. 5 is another cross-sectional view of the switching assembly main body in accordance with the preferred embodiment of the present invention (the direction is different from that of FIG. 4)
Figure 6:
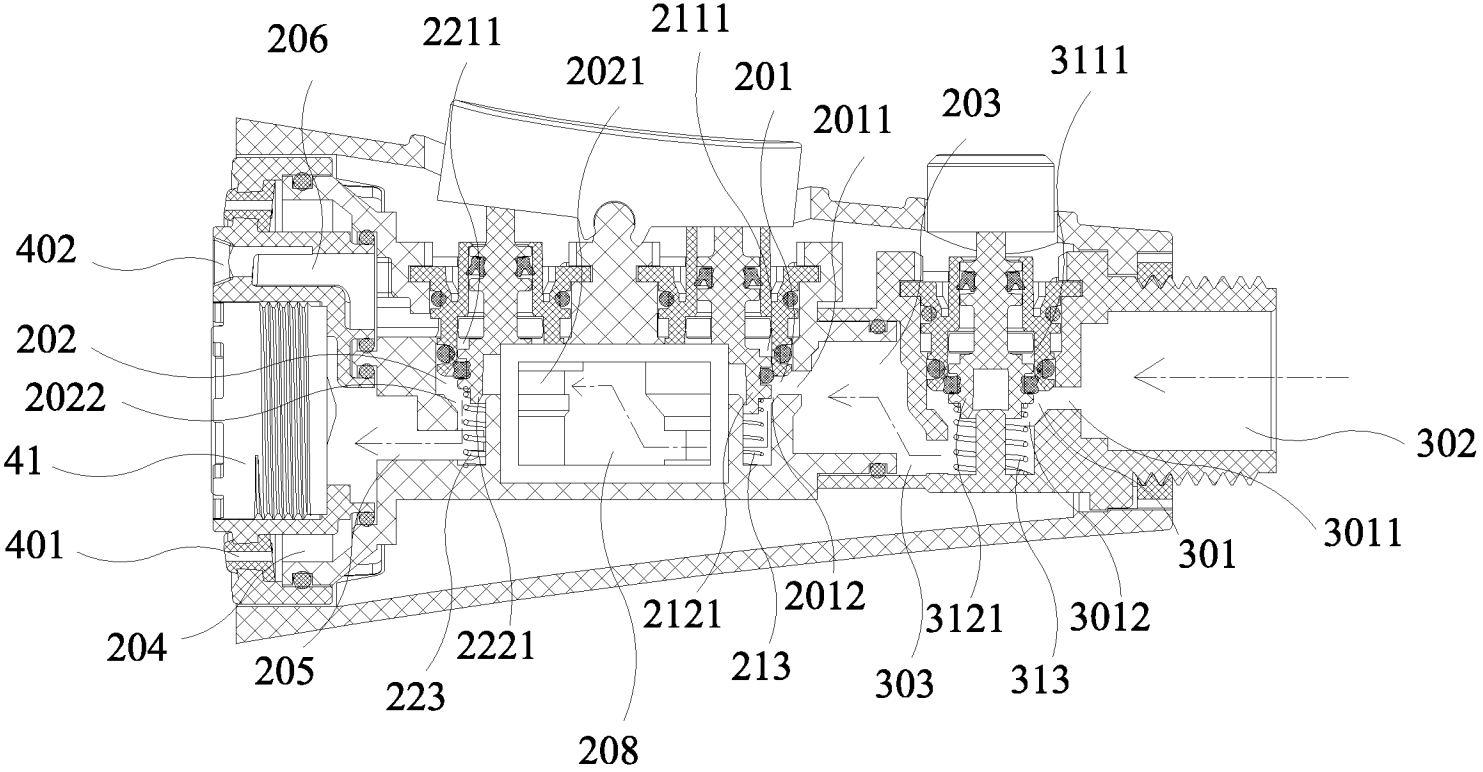
FIG. 6 is a schematic view showing the first spray mode in accordance with the preferred embodiment of the present invention (vertical section)
Figure 7:
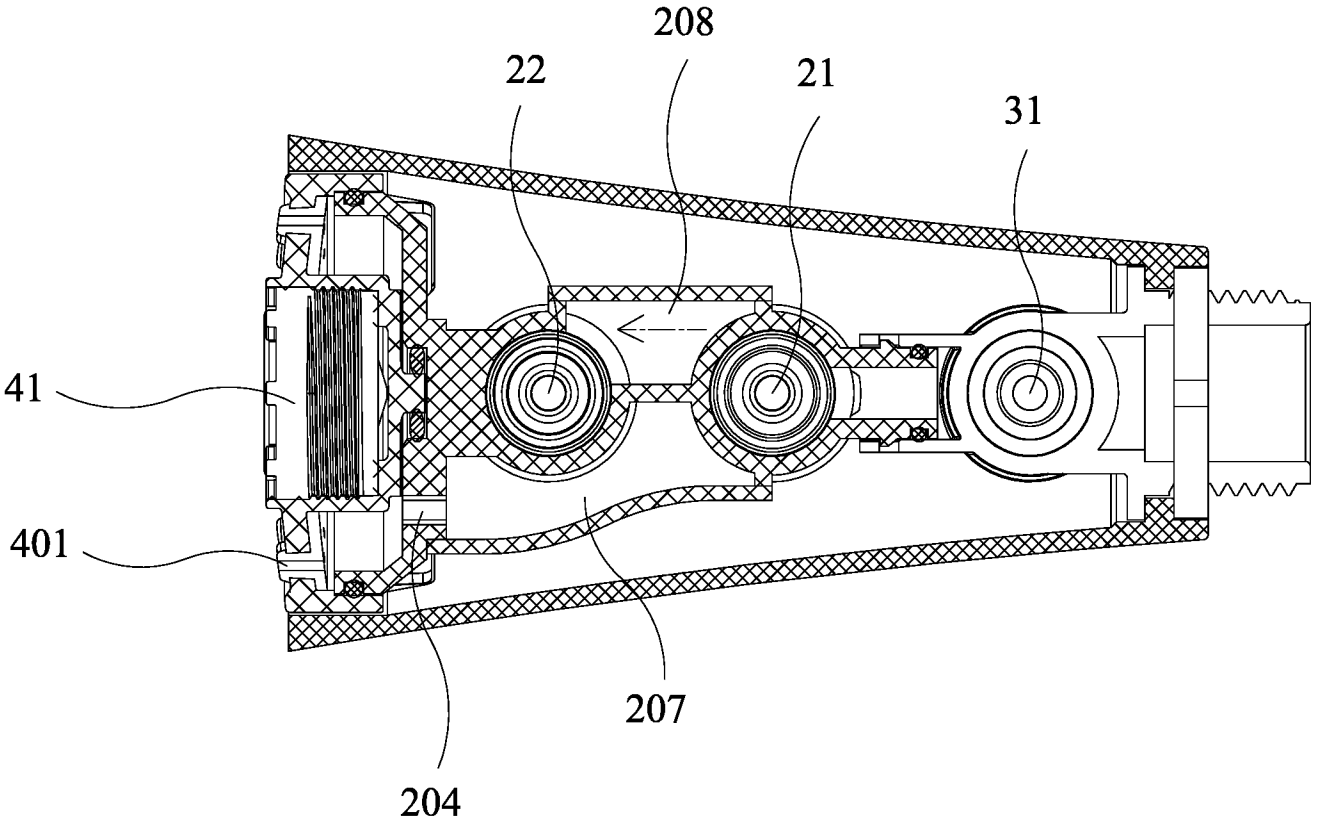
FIG. 7 is a schematic view showing the first spray mode in accordance with the preferred embodiment of the present invention (transverse section)
Figure 8:
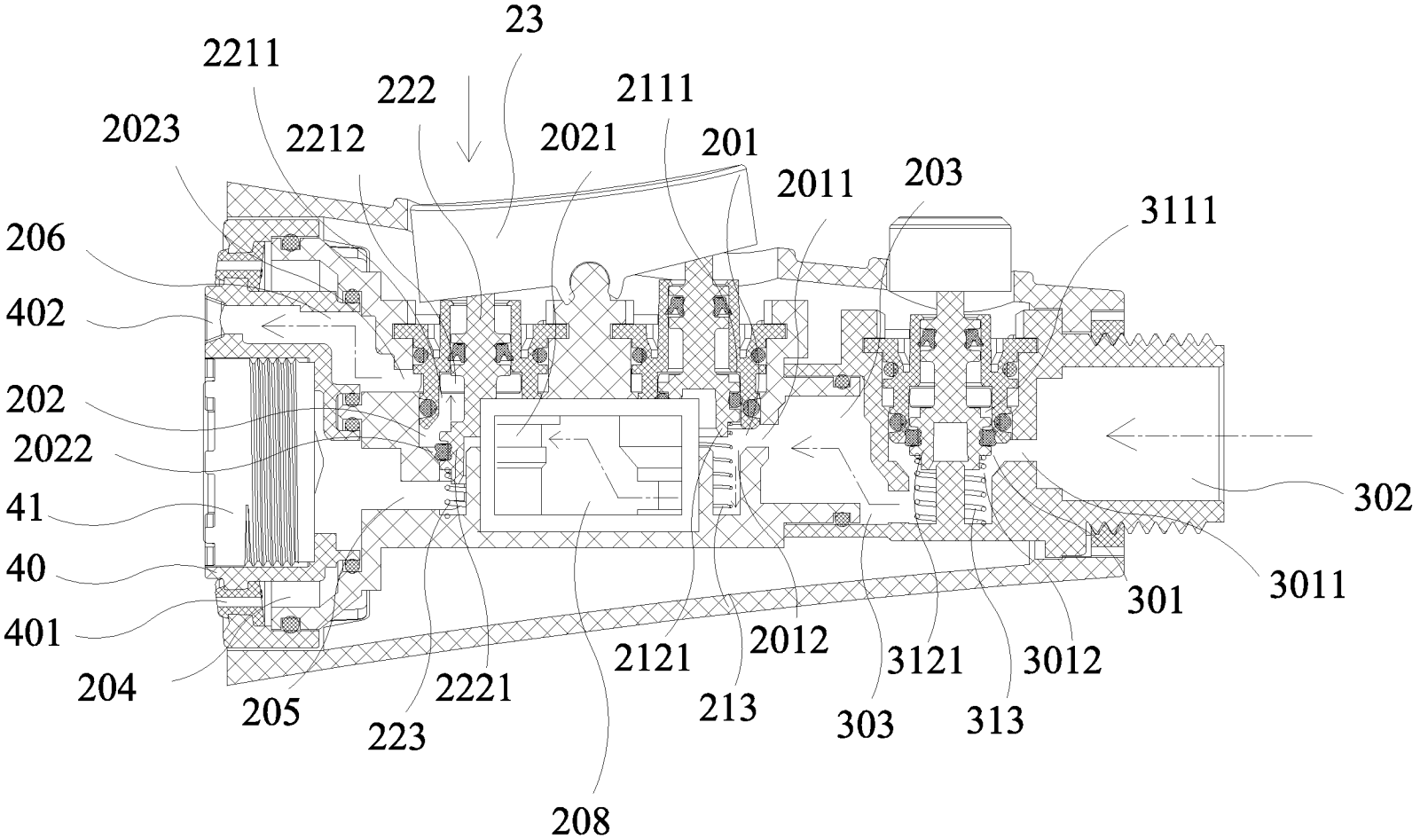
FIG. 8 is a schematic view showing the second spray mode in accordance with the preferred embodiment of the present invention (vertical section)
Figure 9:
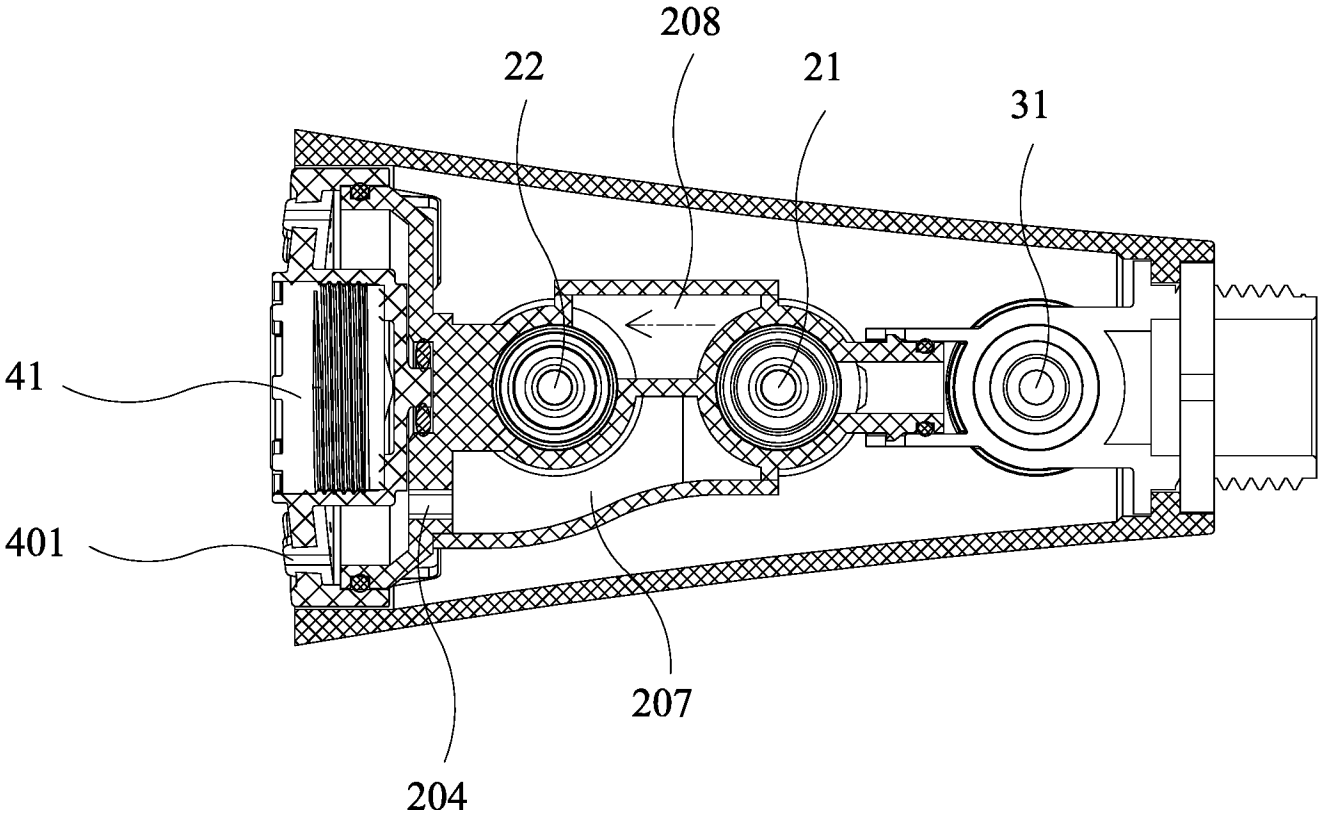
FIG. 9 is a schematic view showing the second spray mode in accordance with the preferred embodiment of the present invention (transverse section)
Figure 10:
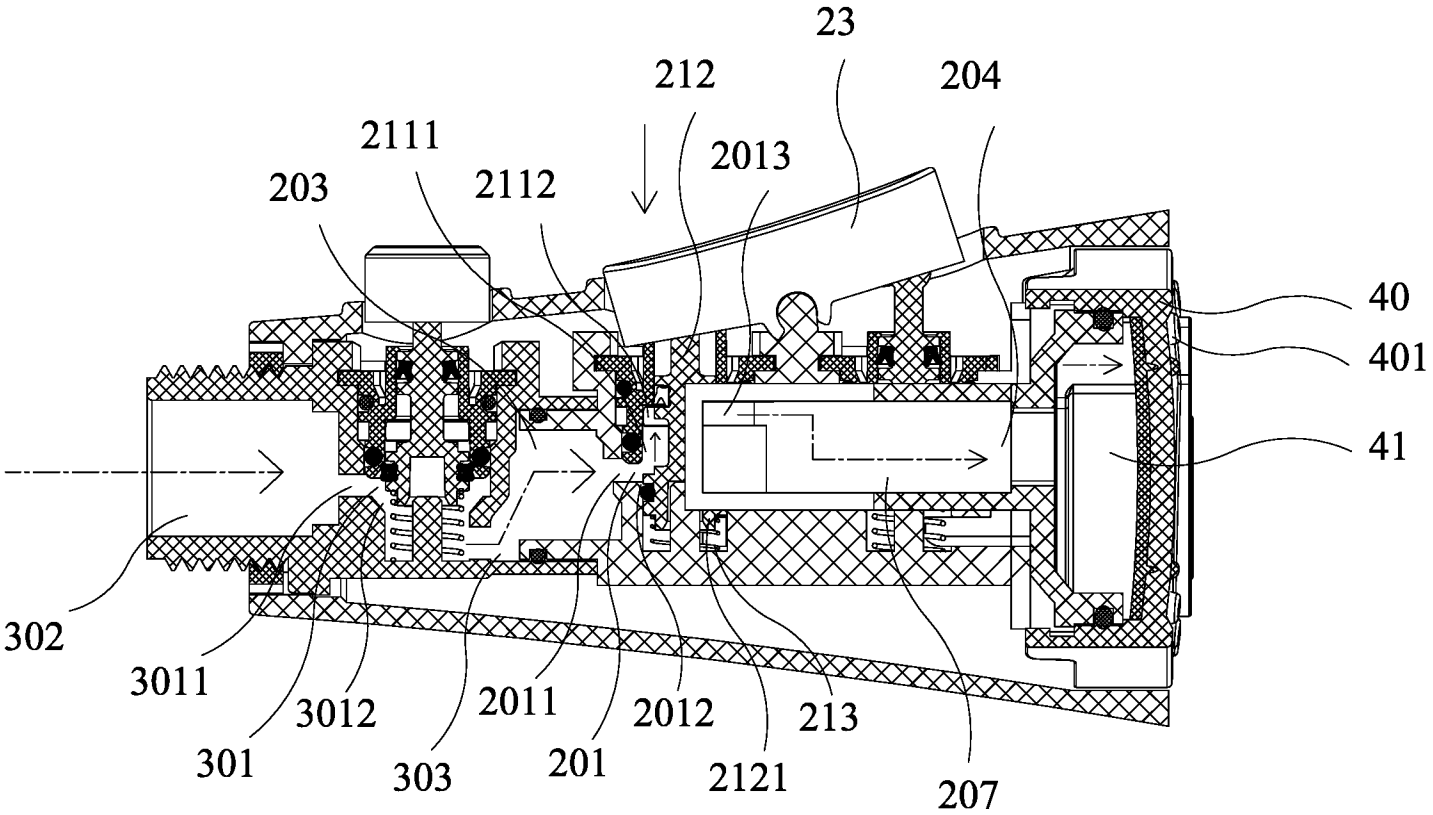
FIG. 10 is a schematic view showing the third spray mode in accordance with the preferred embodiment of the present invention (vertical section)
Figure 11:
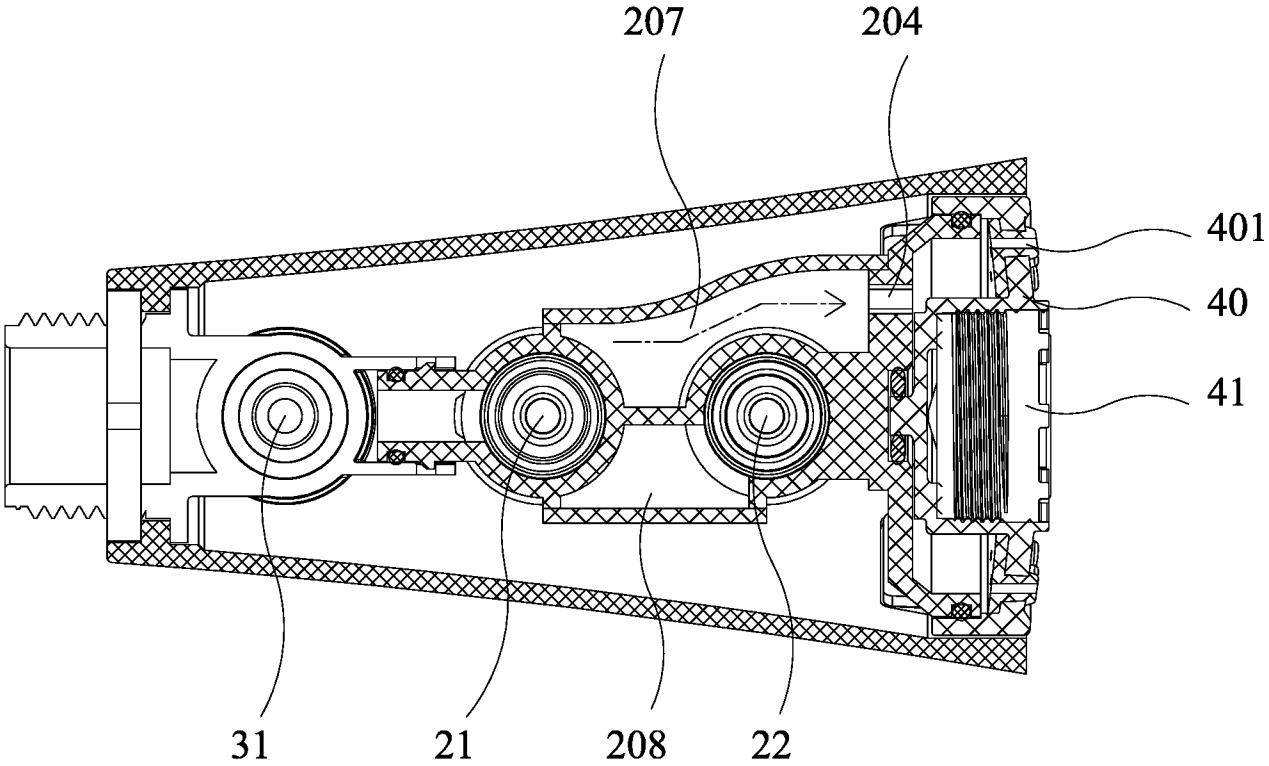
FIG. 11 is a schematic view showing the third spray mode in accordance with the preferred embodiment of the present invention (transverse section)
Figure 12:
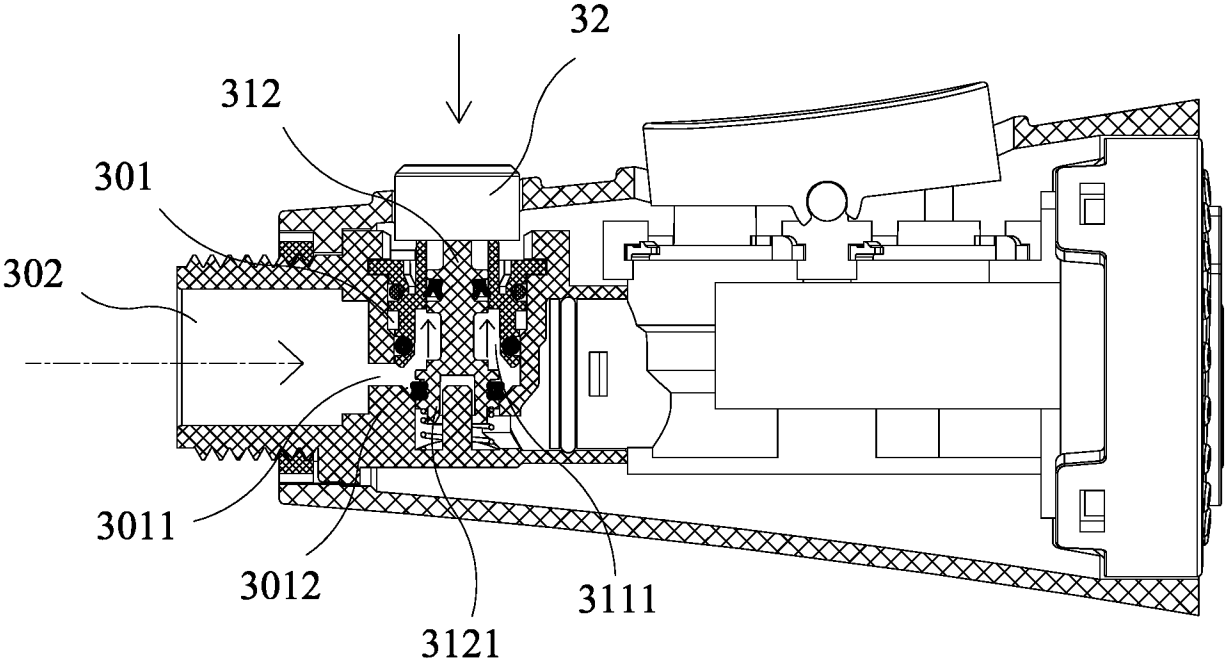
FIG. 12 is a schematic view in accordance with the preferred embodiment of the present invention in a pause state, not discharging water.

Referring to FIG. 4, FIG. 5 and FIG. 12, a temporary stop in discharging water of the present invention is shown. The second button 32 is pressed to move the third switching rod 312 toward the bottom of the fifth water-passing chamber 301. The third sealing portion 3121 is disengaged from the opening of the third chamber 3111 to be sealedly fitted to the fifth water outlet 3012. The other configurations remain unchanged as in the initial state. At this time, the water flow sequentially passes through the second water inlet passage 302 and the third water inlet 3011 to enter the fifth water-passing chamber 301. Because the fifth water outlet 3012 is blocked by the third sealing portion 3121, the water flow cannot enter the subsequent first water-passing chamber 201 and the second water-passing chamber 202, so the water flow cannot enter the first water outlet passage 204, the second water outlet passage 205, and the third water outlet passage 206, that is, when the second button 32 is pressed, the invention is in a pause state, not discharging water. The user does not have to turn off the switch of the pull-out spray head, so that the user can move the spray head over a long distance without splashing water onto the ground or the countertop during the movement. When the second button 32 is pressed until the third sealing portion 3121 abuts against the fifth water outlet 3012, the water flow from the water inlet assembly 3 will be gradually reduced until the water flow is stopped temporarily.

Through the above structure, the present invention includes the first switching unit 21 to control the water flow from the two water outlets of the first water-passing chamber 201, the second switching unit 22 to control the water flow from the two water outlets of the second water-passing chamber 202, and the first button 23 to control the first switching unit 21 and the second switching unit 22, so as to implement three different spray modes of the present invention, which can meet the user's demand for multiple functions. The present invention has the advantages of compact structure, small size, convenient operation for the user, and reduced production cost.

In addition, the present invention can achieve a flow adjustment or on-off control by controlling the water-passing area of the water inlet assembly 3. The components constituting the first switching unit 21, the second switching unit 22 and the third switching unit 31 have the same or similar structure and can be replaced with each other. This means that the components of the three switching units can be produced with the same mold to reduce the production cost, and it is convenient for assembly.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A multifunctional pull-out spray head, comprising a switching assembly, a water inlet assembly and a water outlet assembly that are mounted in a housing, the water inlet assembly and the water outlet assembly being fitted to a water inlet end and a water outlet end of the switching assembly, respectively;

the switching assembly including a switching assembly main body, a first switching unit, a second switching unit, and a first button; a surface of the switching assembly main body being recessed to form a first water-passing chamber and a second water-passing chamber, the first water-passing chamber and the second water-passing chamber have openings arranged in a same direction, the first switching unit being fitted in the first water-passing chamber, the second switching unit being fitted in the second water-passing chamber; a water inlet end of the switching assembly main body being formed with a first water inlet passage, a water outlet end of the switching assembly main body being formed with a first water outlet passage, a second water outlet passage and a third water outlet passage that are not in communication with each other; the first water-passing chamber being formed with a first water inlet, a first water outlet and a second water outlet, the first water outlet, the first water inlet and the second water outlet being sequentially disposed on an inner wall of the first water-passing chamber along an axial direction of the first water-passing chamber, the first water outlet being located at a bottom of the first water-passing chamber; the first water inlet communicating with the first water inlet passage, the second water outlet communicating with the first water outlet passage; the second water-passing chamber being formed with a second water inlet, a third water outlet and a fourth water outlet, the third water outlet, the second water inlet and the fourth water outlet being sequentially disposed on an inner wall of the second water-passing chamber along an axial direction of the second water-passing chamber, the third water outlet being located at a bottom of the second water-passing chamber; the second water inlet communicating with the first water outlet, the third water outlet communicating with the second water outlet passage, the fourth water outlet communicating with the third water outlet passage; a middle portion of the first button being hingedly connected to the surface of the switching assembly main body and being located between the opening of the first water-passing chamber and the opening of the second water-passing chamber;

the first switching unit including a first switching valve, a first switching rod, and a first return spring; the first switching valve being sealedly fitted between the opening of the first water-passing chamber and the first water inlet and blocking the second water outlet; the first switching valve being formed with a first chamber having an opening facing the first water outlet, the opening of the first chamber corresponding in shape and in size to the first water outlet; a side wall of the first chamber being provided with a first slot communicating with the second water outlet; a bottom of the first chamber being provided with a first hole that is disposed along the axial direction of the first water-passing chamber, the first switching rod being movably fitted in the first hole; one end of the first switching rod being movably connected to one end of the first button, another end of the first switching rod being formed with a first sealing portion; the first return spring being disposed between the first sealing portion and the bottom of the first water-passing chamber, the first return spring pressing the first sealing portion to be movably fitted to the opening of the first chamber;

the second switching unit including a second switching valve, a second switching rod, and a second return spring; the second switching valve being sealedly fitted between the opening of the second water-passing chamber and the second water inlet and blocking the fourth water outlet, the second switching valve being formed with a second chamber having an opening facing the third water outlet, the opening of the second chamber corresponding in shape and in size to the third water outlet, a side wall of the second chamber being provided with a second slot communicating with the fourth water outlet; a bottom of the second chamber being provided with a second hole that is disposed along the axial direction of the second water-passing chamber, the second switching rod being movably fitted in the second hole; one end of the second switching rod being movably connected to another end of the first button, another end of the second switching rod being formed with a second sealing portion; the second return spring being disposed between the second sealing portion and the bottom of the second water-passing chamber; the second return spring pressing the second sealing portion to be movably fitted to the opening of the second chamber.

2. The multifunctional pull-out spray head as claimed in claim 1, wherein the water inlet assembly includes a water inlet assembly main body, a third switching unit, and a second button; a surface of the water inlet assembly main body is recessed to form a fifth water-passing chamber, the fifth water-passing chamber has an opening in the same direction as the opening of the first water-passing chamber, the third switching unit is fitted in the fifth water-passing chamber; a water inlet end of the water inlet assembly main body is formed with a second water inlet passage, a water outlet end of the water inlet assembly main body is formed with a fourth water outlet passage, the fourth water outlet passage is in communication with the first water inlet passage; the fifth water-passing chamber is formed with a third water inlet and a fifth water outlet, the third water inlet is disposed on a side wall of the fifth water-passing chamber, the fifth water outlet is located at a bottom of the fifth water-passing chamber; the third water inlet communicates with the second water inlet passage, the fifth water outlet communicates with the fourth water outlet passage;

the third switching unit includes a third switching valve, a third switching rod, and a third return spring; the third switching valve is sealedly fitted between the opening of the fifth water-passing chamber and the third water inlet, the third switching valve is formed with a third chamber having an opening facing the fifth water outlet, the opening of the third chamber corresponds in shape and in size to the fifth water outlet, a bottom of the third chamber is provided with a third hole that is disposed along an axial direction of the fifth water-passing chamber, the third switching rod is movably fitted in the third hole; one end of the third switching rod is formed with a third sealing portion, the third return spring is disposed between the third sealing portion and the bottom of the fifth water-passing chamber, and the third return spring presses the third sealing portion to be movably fitted to the opening of the third chamber.

3. The multifunctional pull-out spray head as claimed in claim 2, wherein another end of the third switching rod is connected to the second button.

4. The multifunctional pull-out spray head as claimed in claim 3, wherein the housing is formed with a first through hole corresponding in position to the first button, the first button is movably disposed in the first through hole; the housing is formed with a second through hole corresponding in position to the second button, and the second button is movably disposed in the second through hole.

5. The multifunctional pull-out spray head as claimed in claim 1, wherein the one end of the first switching rod is connected to the one end of the first button.

6. The multifunctional pull-out spray head as claimed in claim 1, wherein the bottom of the first water-passing chamber is provided with a first limiting post, the first limiting post is disposed along the axial direction of the first water-passing chamber, the first sealing portion is formed with a first sleeve hole, and the first sleeve hole is moveably sleeved onto an outer circumference of the first limiting post.

7. The multifunctional pull-out spray head as claimed in claim 1, wherein an outer circumference of the first switching valve is provided with a first sealing ring and a second sealing ring that are disposed along a circumferential direction of the first switching valve, the first sealing ring and the second sealing ring are located at upper and lower ends of the first slot.

8. The multifunctional pull-out spray head as claimed in claim 1, wherein a middle portion of the first switching rod is provided with a first sealing ring, and the first sealing ring is moveably fitted in the first hole.

9. The multifunctional pull-out spray head as claimed in claim 7, wherein an outer circumference of the first sealing portion is sleeved with a third sealing ring that is disposed along a circumferential direction of the first sealing portion, and the third sealing ring is moveably fitted to the opening of the first chamber or the first water outlet.

10. The multifunctional pull-out spray head as claimed in claim 6, wherein the bottom of the second water-passing chamber is provided with a second limiting post, the second limiting post is disposed along the axial direction of the second water-passing chamber, the second sealing portion is formed with a second sleeve hole, and the second sleeve hole is moveably sleeved onto an outer circumference of the second limiting post.

11. The multifunctional pull-out spray head as claimed in claim 10, wherein an outer circumference of the second switching valve is provided with a fourth sealing ring and a fifth sealing ring that are disposed along a circumferential direction of the second switching valve, the fourth sealing ring and the fifth sealing ring are located at upper and lower ends of the second slot.

12. The multifunctional pull-out spray head as claimed in claim 8, wherein a middle portion of the second switching rod is provided with a second sealing ring, and the second sealing ring is movably fitted in the second hole.

13. The multifunctional pull-out spray head as claimed in claim 8, wherein an outer circumference of the second sealing portion is sleeved with a third sealing ring that is disposed along a circumferential direction of the second sealing portion, and the third sealing ring is movably fitted to the opening of the second chamber or the third water outlet.

14. The multifunctional pull-out spray head as claimed in claim 1, wherein the first switching valve is rotatably fitted to the opening of the first water-passing chamber.

15. The multifunctional pull-out spray head as claimed in claim 1, wherein the second switching valve is rotatably fitted to the opening of the second water-passing chamber.

16. The multifunctional pull-out spray head as claimed in claim 10, wherein the bottom of the fifth water-passing chamber is provided with a third limiting post, the third limiting post is disposed along the axial direction of the fifth water-passing chamber, the third sealing portion is formed with a third sleeve hole, and the third sleeve hole is moveably sleeved onto an outer circumference of the third limiting post.

17. The multifunctional pull-out spray head as claimed in claim 2, wherein the third switching valve is rotatably fitted to the opening of the fifth water-passing chamber.

18. The multifunctional pull-out spray head as claimed in claim 1, wherein the water outlet assembly includes a water outlet assembly main body, a bubbler, a nozzle, and a gasket; the water outlet assembly main body is provided with a plurality of first perforations and a plurality of second perforations; a central portion of the water outlet assembly main body is formed with a mounting trough, the bubbler is locked in the mounting trough through the nozzle, the gasket is disposed between the bubbler and the water outlet assembly main body; the first water outlet passage is in communication with the first perforations, the second water outlet passage is in communication with a bottom of the mounting trough, and the third water outlet passage is in communication with the second perforations.

* * * * *